United States Patent [19]

Barnaby

[11] 3,951,443

[45] Apr. 20, 1976

[54] SECURITY LOCK

[75] Inventor: Perry J. Barnaby, St. Clair Shores, Mich.

[73] Assignee: Fruehauf Corporation, Detroit, Mich.

[22] Filed: Mar. 27, 1975

[21] Appl. No.: 562,556

[52] U.S. Cl. ..... 292/327; 85/7; 292/302

[51] Int. Cl.[2] ..... E05C 13/02

[58] Field of Search .... 292/218, 302, 327, DIG. 32, 292/151, 154, 148; 70/422, 97, 129; 85/5 R, 7, 8.8; 29/200 D, 426; 285/3, 80

[56] References Cited

UNITED STATES PATENTS

| | | | |
|---|---|---|---|
| 79,801 | 7/1868 | Adams | 292/327 X |
| 151,859 | 6/1874 | Dodge | 292/327 |
| 1,131,085 | 3/1915 | Reilly | 292/327 UX |
| 1,332,291 | 3/1920 | Goodell | 292/327 |
| 1,397,101 | 11/1921 | Kelly | 85/8.8 X |
| 1,571,159 | 1/1926 | Posson | 292/DIG. 32 X |
| 2,843,350 | 7/1958 | Wilson | 85/5 R X |
| 3,633,954 | 1/1972 | Tantlinger | 292/DIG. 32 X |
| 3,768,849 | 10/1973 | Sytko | 292/327 |
| 3,862,775 | 1/1975 | Gudmundsen | 292/327 |

FOREIGN PATENTS OR APPLICATIONS

| | | | |
|---|---|---|---|
| 86,048 | 2/1921 | Austria | 292/327 |
| 105,999 | 11/1926 | Austria | 292/327 |
| 86,996 | 1/1922 | Austria | 292/327 |
| 107,771 | 1/1927 | Austria | 292/327 |
| 408,064 | 3/1943 | Italy | 292/302 |
| 708,150 | 4/1954 | United Kingdom | 285/3 |

*Primary Examiner*—James T. McCall
*Assistant Examiner*—Thomas J. Holko
*Attorney, Agent, or Firm*—Harness, Dickey & Pierce

[57] ABSTRACT

A security system for double doors which incorporates keeper blocks secured to the doors near their free edges in positions such that they overlap vertically when the doors are closed. The blocks have holes extending vertically therethrough which align when the doors are closed to form a passage for reception of a lock pin assembly having irremovable heads above and below the blocks. The lock pin can only be removed by destroying the pin or the keeper blocks or their supports. The blocks are secured to and shielded by vertically extending reinforcing ribs attached to the doors near their free edges. A pilot hole of a diameter exceeding that of the pin extends through one of the blocks perpendicular to the axis of the pin so that the pin can be cut by means of a drill, allowing the two severed sections of the pin to be moved out of the aligned holes to free the doors.

11 Claims, 11 Drawing Figures

SECURITY LOCK

BACKGROUND OF THE INVENTION

Large van-like containers which are commonly transported both by rail and by truck have been subjected to costly pilferage, particularly when on railroad cars. Such pilferage is largely committed by thieves who are relatives novices, and/or who are employees, whose presence in the vicinity is not a cause for suspicion. Such persons do not as a practical matter have heavy tools or equipment, or explosives, to aid in their criminal activities. Such thefts have been accomplished by breaking the relatively thin seals placed upon the conventional locking systems for the door or doors of such containers. The object of the present invention is to provide an improved, simple, low-cost locking system which is adequate to effectively deter such thievery, and which prevents opening the doors without the use of tools which cannot be carried by such a pilferer without the mere fact of possession of the tools revealing an intention to engage in an unusual or illegal activity.

BRIEF DESCRIPTION OF THE FIGURES OF DRAWING

DETAILED DESCRIPTION OF PREFERRED FORMS OF THE INVENTION

Figure 1:
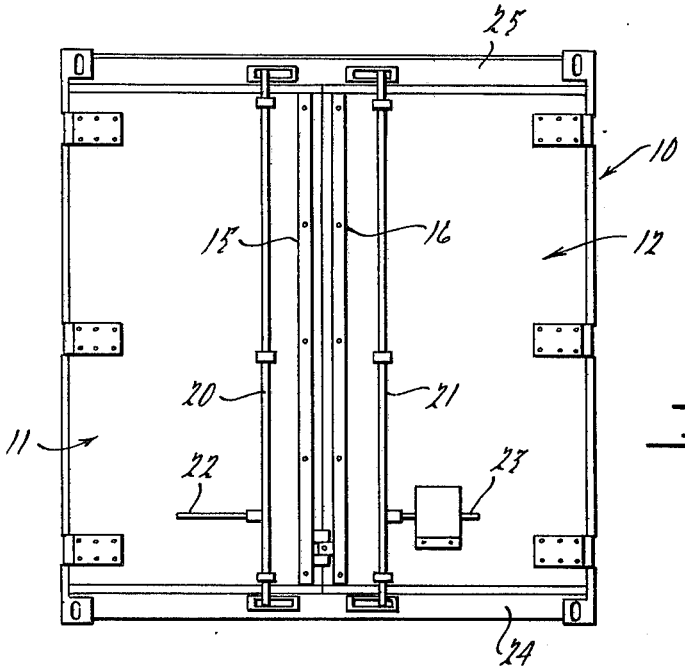
FIG. 1 is a rear elevational view of a van-type container having double doors equipped with the improved locking means of this invention.
Figure 3:
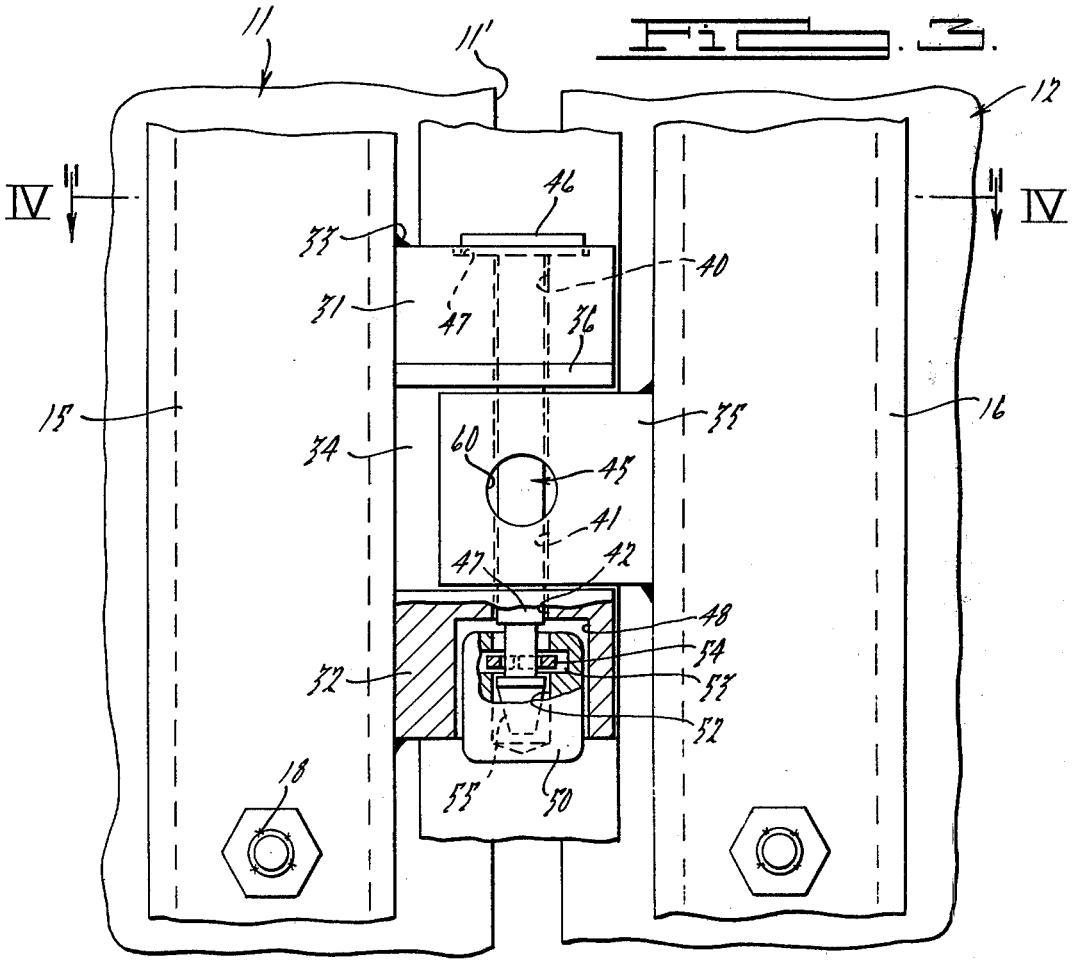
FIG. 3 is a fragmentary elevational view from the rear, partly broken away, of the portions shown in FIG. 2.

Reference character 10 designates generally a van-type container body of a type which may be transported over the road on a truck or semi-trailer, and/or also transported on a railway freight car. Frequently valuable cargo such as appliances and other items desired by thieves are carried in such van-type containers. In some environments where access may be had to the doors, it has been possible for thieves to remove at least one or more items of value, and then reclose the doors, without being detected.

FIG. 1 illustrates the rear of such a container of a type in common use, having a pair of double doors generally designated 11, 12, hinged to the rear ends of the side walls of the container and meeting at the center. A gasket 14 protects the center opening against weather and dust. Secured to each door near but spaced from and parallel to the free vertical edge is a stiffening rib 15, 16 formed of relatively heavy walled square tubing. The ribs 15, 16 are effectively secured against removal, as by nuts and bolts, the nuts being welded to the bolts to prevent removal, as indicated at 18. The doors may also be provided with conventional locking means comprising vertical rock shafts 20, 21 rotatable by means of handles 22, 23 so as to move cam-type lock bolts (not shown) into and out of hooked engagement with abutments (not shown) on the sill and header portions 24, 25 of the body of the container. The details of such container and locking portions thus far described do not form a part of the present invention, and the construction thereof may vary. Typically, some means is provided for holding and sealing the lock operating handles 22, 23 in the locked position. Due to the fact that such handles are exposed on the surface of the door, it is not practical to provide locking means for such handles which cannot be broken or severed quickly, by means of tools such as clipping devices which can be of a compact character which is easily concealed.

In order to prevent opening the doors of a filled container without the use of bulky tools not normally being carried by an employee or other person in the vicinity of such filled containers, this invention incorporates means for utilizing a lock bolt in the form of a double headed pin which, once installed, can only be removed by severing the pin; the severing of such a pin, however, when located and installed in accordance with the present invention, requiring the use of a heavy-duty power drill which must be connected to a source of power and which cannot be readily concealed on the person.

Attached to the rib 15 in vertically spaced relation are a pair of rectangular keeper blocks 31, 32, welded to the side of the rib which faces in the same direction as the free edge of the door 11 and projecting beyond the free edge 11' of the door far enough to substantially fill the space between the ribs 15 and 16. Ample room can be allowed, between the blocks and the other rib 16 for clearances, however, including any clearance which may be required due to the fact that the container itself is sometimes somewhat distorted temporarily, without thereby interfering with the effective shielding afforded to the blocks by the ribs. The blocks 31, 32 are secured to the rib 15 by welding, as indicated at 33.

A third block 35, also of rectangular form, is welded to the corresponding opposed outer surface of the rib 16 in position to project into the space 34 between the blocks 31, 32 when the doors are closed, the vertical dimension of the block 35 being such as substantially to fill the space 34 in the vertical direction. The lower front corner of block 31 is provided with a lead-in chamfer 36 and a similar chamfer 37 is provided on the upper front corner of the lower block 32 to guide the block 35 into the space 34 in event of any misalignment due to distortion such as mentioned above.

Vertical holes 40, 41 and 42 are drilled in the blocks 31, 35 and 32, respectively, in such positions as to align coaxially when the doors are closed and locked, defining a passage extending entirely through all three blocks for the reception of a double-headed lock bolt, of a known irremovable type, generally designated 45.

The bolt 45 is in the form of a pin which slides easily in the passage defined by the holes 40, 41, 42 and has an integral head 46 which when the bolt is installed is seated in a counterbore 47 at the upper end of bore 40. The lower end of the hole 42 in block 32 is provided with a larger and deeper counterbore 48 for reception and shielding of an initially separate locking head 50 which after installation upon the tapered and shouldered lower end 55 of the pin portion 47 of the lock bolt cannot be removed without destroying the lock bolt or its supporting means.

Although the construction of the irremovable lock bolt assembly is subject to variation and does not in itself form a part of the present invention, it may, as shown, comprise the aforementioned block 50 having a bore 52 extending downwardly thereinto from the top but blind and closed at the bottom. An internal groove 53 in bore 52 contains a heavy snap ring 54 which is expandable during insertion of the tapered bottom head 55 of the pin portion 47 to permit head 55 to pass below the ring, but which contracts due to its own resiliency after the head is fully inserted, to overlie the shoulder which forms the top wall of pin head 55, while also remaining partially in groove 53, thereby permanently locking the bottom block 50 of the bolt 45 against separation.

Figure 4:
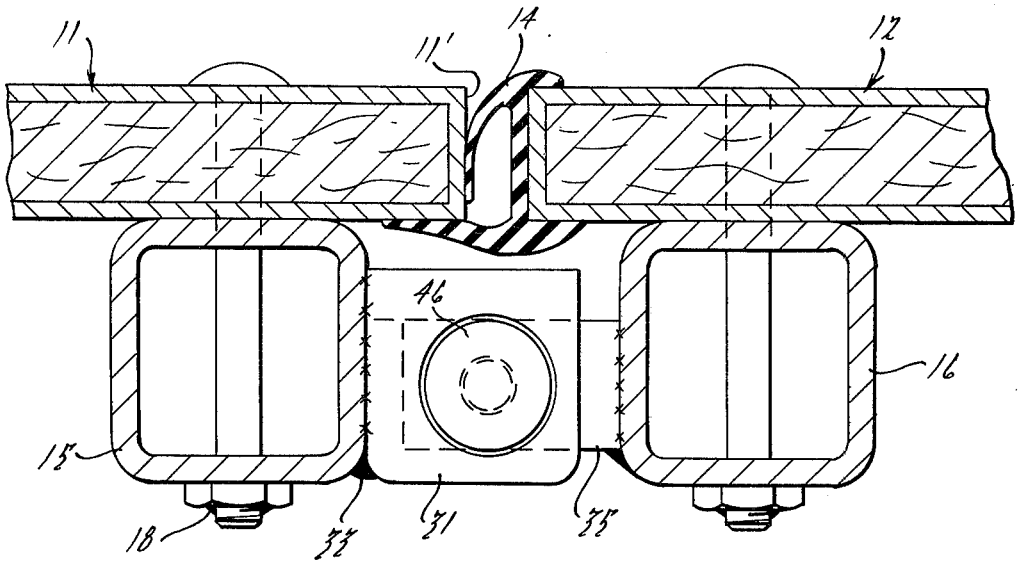
FIG. 4 is a horizontal section taken substantially on the line IV — IV of FIG. 3 and looking in the direction of the arrows.
Figure 2:
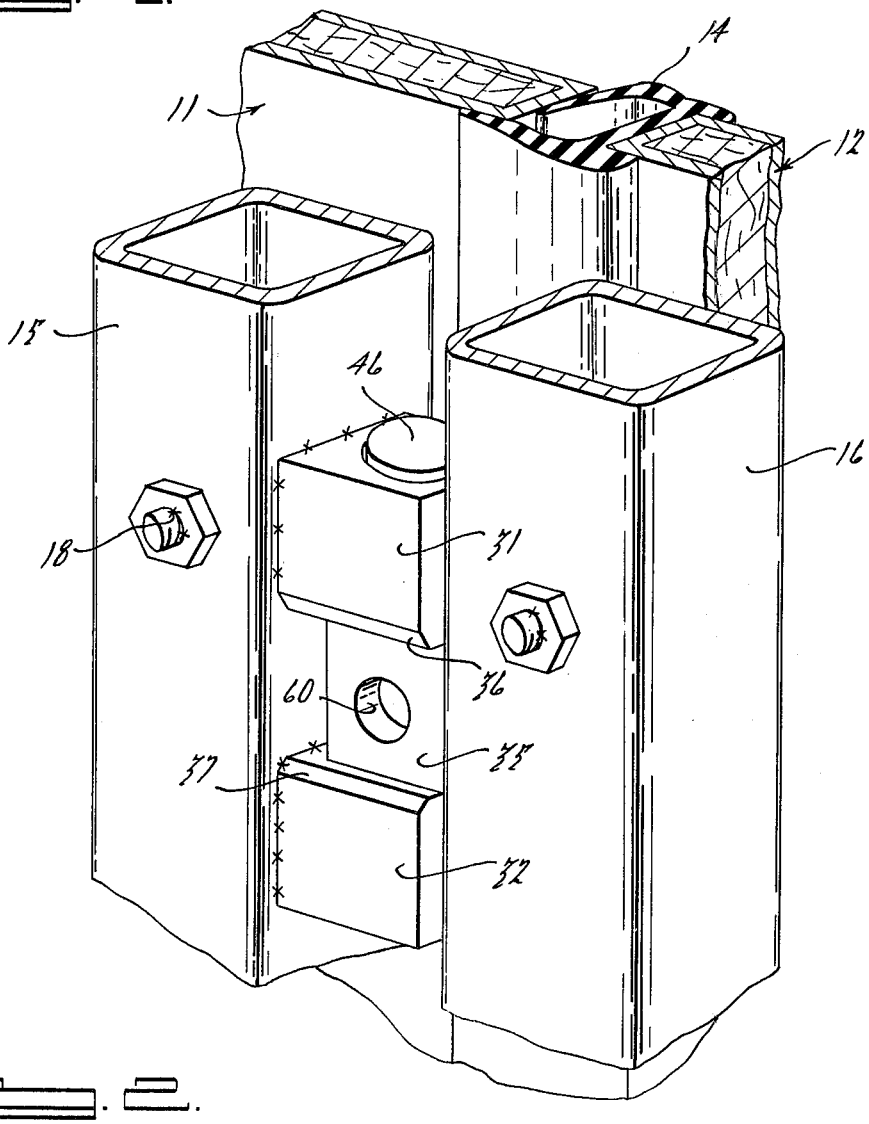
FIG. 2 is a fragmentary perspective view on a larger scale showing the lock assembly and adjacent parts.

It will be noted that as best shown in FIG. 4 the blocks 31, 32, 35 lie substantially behind the outer plane of the ribs 15 and 16, and are shielded both on the sides and rear so that a hacksaw blade cannot be effectively used on the shank of the pin portion 47, even if clearance between the block 35 and the blocks 31, 32 is sufficient to permit insertion of a blade. This is due to the fact that an effective length of stroke of the hacksaw blade is not permitted, by this construction, so that the pin could not be severed by this means within a reasonable length of time. In addition, the top head 46 and bottom head block 50 of the lock bolt pin assembly are effectively protected by the counterbores 47 and 48 against any attempt to use a cold chisel or such device.

The block 35 is provided with a pilot hole 60 extending from the exposed surface thereof to intersecting relation with the hole 41, the pilot hole being somewhat larger in diameter than hole 41. A large power drill can be used by inserting the drill in the hole 60 and operating it to sever the pin, permitting the upper and lower halves to move out of their respective passages to permit opening the doors.

Such a drill is of course kept available at the destinations of shipments, and the doors are quickly releasable in the indicated manner. Relocking the container is also a quick and simple operation, requiring merely dropping in a new bolt pin 45 and installing a new head 50 thereon.

Figure 5:
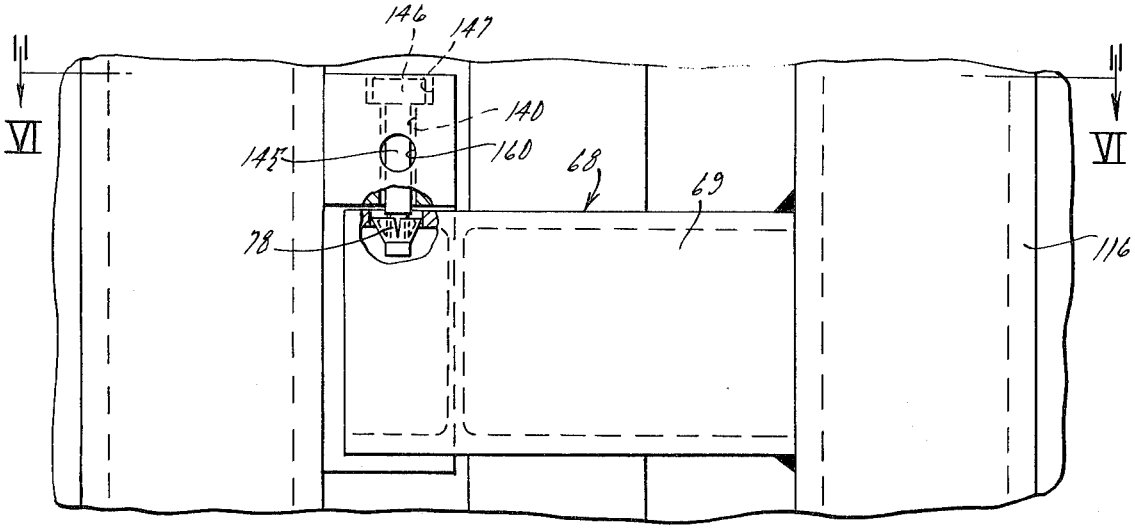
FIG. 5 is a view similar to FIG. 3 showing a modified construction.
Figure 6:
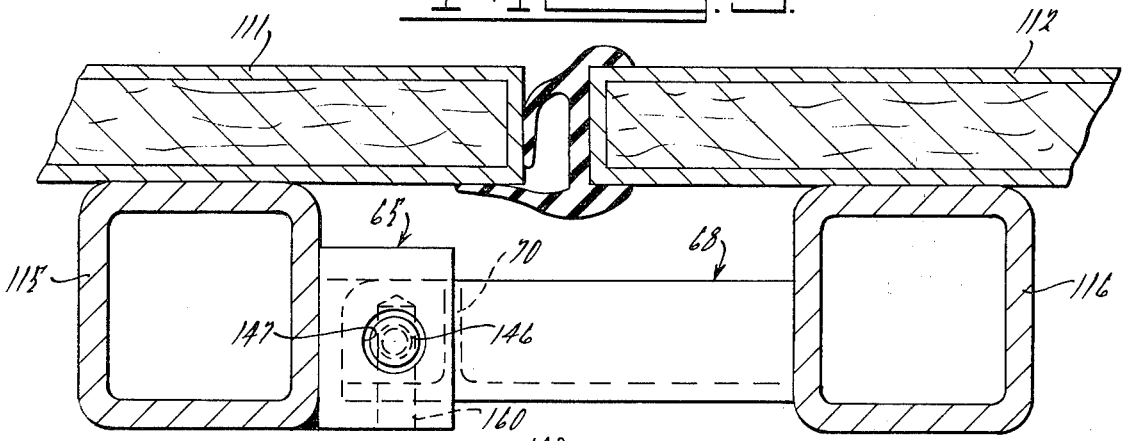
FIG. 6 is a horizontal section taken substantially on the line VI — VI of FIG. 5 and looking in the direction of the arrows.
Figure 8:
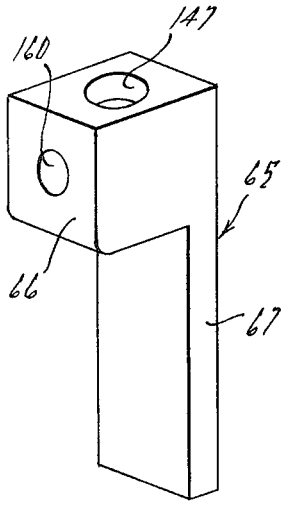
FIGS. 8 and 9 are perspective views to keeper block members.

In the modified construction shown in FIGS. 5–9, parts similar to components already described are designated by corresponding reference characters 100 integers higher, and in many instances will not require redescription. Only a single keeper block is carried by each door, in this form of the invention. The keeper block 65, secured to the rib 115 of the roadside door 111, has a rearwardly projecting upper part 66 through which the vertical bolt hole 140 is drilled, and an integral depending flat plate portion 67 which overlies the surface of the door, although it may be spaced therefrom, as shown in FIG. 6. The horizontal drilling pilot hole 160 is also formed in the top portion 66 of block 65.

Keeper block member 68, secured to the curbside door by welded attachment to rib 116 is of generally box form and, extends across the rear face and beyond the free edge of the door to a position which permits its horizontal top web 81 to closely underlie the projecting portion 66 of block 65 when the doors are closed. Keeper block member 68 is in the form of a heavy gauge steel U-channel with its bight web 69 forming a flat protective rear wall its top flange 81. Access to the bolt 145 is prevented by web 69 and by the top and bottom flanges 81, 82 of the channel, which project horizontally forwardly with respect to the container body and closely abut plate portion 67 when the doors are closed. Further protection is provided by an integral cross web 70 which joins the top and bottom flanges 81, 82 and which is so positioned, as brought out in FIG. 6, that when the doors are closed it cooperates with block 65, rib 115, and the other flanges of member 68, to shield the lower end of the bolt and enclose it within the space 73. A hole 71 which is larger than hole 140 and extends vertically through top flange 81 of the channel is positioned to underlie and align axially with hole 140 when the doors are closed.

Figure 7:
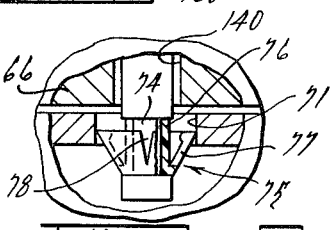
FIG. 7 is a sectional detail of the locking portion in the locked position, with a fragmentary showing of adjacent parts.
Figure 9:
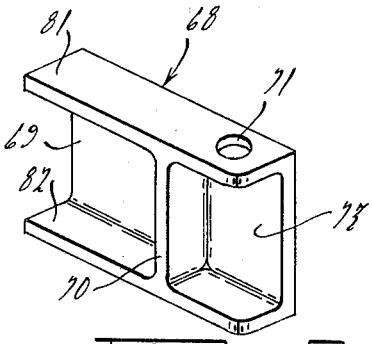

The bolt 145 has an upper head 146 which seats in a counterbore 147 at the upper end of hole 140. The lower extremity of the shank of the bolt projects below head portion 66 of block 65 far enough to extend into the hole 71 and a short distance therebelow, as shown in FIGS. 5 and 7. Near its lower end the stem of the bolt is provided with a cylindrical portion 74 of reduced diameter upon which a resilient locking collar generally designated 75 is fitted. The collar 75, which may be molded of a tough and relatively stiff plastic may be molded in place, and consists of a cylindrical supporting sleeve portion 76 fitting snugly on the reduced portion 74 of the bolt and a conically flaring holding portion 77 integrally joined to the sleeve portion 76 at the lower end of the latter and extending upwardly and angularly outwardly therefrom when the locking member is relaxed, as shown in FIGS. 5 and 7. The holding portion 77 is compressible radially inwardly to permit it to pass downwardly through the hole 140 and into the hole 71. Hole 71 is of substantially greater diameter than the hole 140, so that the collar 77, after passing below the lower end of hole 140, springs outwardly to underlie the block 66 in the area around the bottom of the hole 140 and prevent upward removal of the bolt. The portion 77 may be slotted or otherwise relieved as indicated at 78 to facilitate collapse thereof during passage through the hole 140. Preferably the periphery of the portion 77 lies inside the hole 71, when the parts are assembled and locked, so that the wall of hole 71 strongly resists spreading of the collar, or turning it inside out, in event a would-be thief should gain access to the bolt and attempt to force it back up. The bolt itself resists with its entire shear strength any effort to pry open the doors or keeper blocks.

Figure 10:
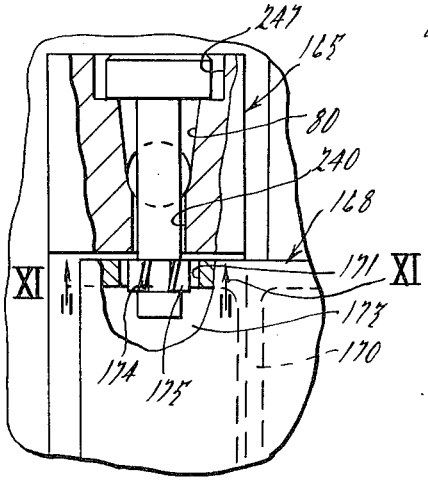
FIG. 10 is a fragmentary elevational view, partly broken away and in section, showing a further modification.
Figure 11:
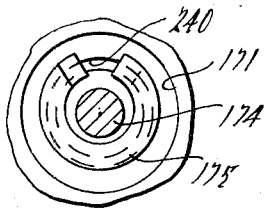
FIG. 11 is a cross section taken substantially on the line XI — XI of FIG. 10 and looking in the direction of the arrows.

The further modified construction shown in FIGS. 10 and 11 is similar to the embodiment of FIGS. 5–9 insofar as the arrangement of the keeper blocks 165, 168 on the doors is concerned. In this embodiment parts corresponding to features already described are designated by similar reference characters one hundred integers higher than those embodied in FIGS. 5–9. The vertical bolt hole 240 in keeper block 165 is provided with a similar counterbore 247 at its top. Below the counterbore the hole 240 is provided with a gradually conically reduced portion 80 which at its upper end is of a diameter sufficient to admit a metallic split collar 175 fitted on the reduced lower portion 174 of the stem of the bolt. The collar 175 tends to expand under its own resiliency to a diameter exceeding that of the lower extremity of the hole 240, but is cammable inwardly by the conically sloping wall 80 so that it can be forced downwardly through and out of the lower end of the hole 240 into the enlarged hole 171 in the keeper block 168. As in the previous embodiment, the ring 175 lies in the hole 171 in the lower keeper block when the parts are in the locked condition. The hole 171 is of a diameter which prevents the ring 175 from being expanded sufficiently to enable it to be removed from the lower end of the stem of the bolt, even if a thief should gain access to the compartment defined by the space 173.

Although double swinging doors have been illustrated, it will be obvious that a single door of a swinging, sliding or rollup type or other character, movable toward a structural part which might be fixed, rather than constituting another door, would equally be adapted to be secured by means of the present invention; and that other differences in the environment and in structural details may be made without departing from the fair and intended scope of the appended claims.

This Detailed Description of Preferred Forms of the Invention, and the accompanying drawings, have been furnished in compliance with the statutory requirement to set forth the best mode contemplated by the inventor of carrying out the invention. The prior portions consisting of the "Abstract of the Disclosure" and the "Background of the Invention" are furnished without prejudice to comply with administrative requirements of the Patent Office.

What is claimed is:

1. A system for securing a door to an adjacent structure comprising a keeper block on the door, a keeper block on the adjacent strucure, said keeper blocks being positioned to be in close juxtaposed relation when said door is in the closed condition, each of said keeper blocks having a passage therethrough, said passages being positioned so as to be aligned with each other when the door is in the closed condition thereby forming a continuous passage extending through both blocks for the reception of a bolt, one of said keeper blocks having a pilot hole of a diameter at least equal to that of the bolt passage extending inwardly from an outer surface of the block on an axis generally perpendicular to but aligned with the axis of the bolt passage and intersecting the bolt passage whereby a bolt disposed in and extending through said continuous passage can be severed by means of a drill inserted in the pilot hole.

2. In a locking system for a door having a free edge movable toward and away from another part during opening and closing thereof, the novel combination which comprises at least two keeper blocks, one attached to the door and the other to said other part, each of said blocks having a recessed area and each having a passage extending from the recessed area to a surface of the block which faces the other block when the door is closed, said passages being positioned to align coaxially with each other in close end-abutting relation when the door is closed, so as to form a substantially continuous passage for reception of a bolt extended through the blocks to prevent opening of the door, at least one of the blocks having a pilot hole of a diameter at least equal to that of the bolt passage extending inwardly from an outer surface of the block on an axis generally perpendicular to but aligned with the axis of the bolt passage and intersecting such passage, whereby a bolt having spaced abutment portions in said recessed areas and an intermediate stem portion thereof extending through and trapped in the continuous passage can be severed by means of a drill inserted in the pilot hole, and whereby access to the abutment portions and to the stem portion is restricted by the blocks.

3. In a locking system for a pair of substantially planar double doors having free vertical edges movable toward and away from each other during opening and closing thereof, the novel combination which comprises at least two keeper blocks, one attached to each door, each of said blocks having a recessed area and each having a passage extending from the recessed area to a surface of the block which faces the other block when the doors are closed, said passages being positioned to align coaxially with each other in close end-abutting relation when the doors are closed, so as to form a substantially continuous passage for reception of a bolt extended through the blocks to prevent separation of the doors, at least one of the blocks having a pilot hole of a diameter at least equal to that of the bolt passage extending inwardly from an outer surface of the block on an axis generally perpendicular to but aligned with the axis of the bolt passage and intersecting such passage, whereby a bolt having spaced abutment portions in said recessed areas and an intermediate stem portion thereof extending through and trapped in the continuous passage can be severed by means of a drill inserted in the pilot hole, and whereby access to the abutment portions and to the stem portion is restricted by the blocks.

4. In a locking system for a pair of substantially planar double doors having free vertical edges movable toward and away from each other during opening and closing thereof and having a vertical reinforcing rib on and projecting outwardly from the outer surface of each door, said ribs being located relatively close to but spaced from the free edge of the door, the novel combination which comprises at least two rectangular keeper blocks, one attached to each rib and extending laterally from the rib parallel to the plane of the door, and at least one thereof extending to a position beyond the free edge of the door, said blocks being of such length horizontally, and staggered vertically to such extent, as to closely overlap vertically when the doors are closed, and lying substantially between the plane of the closed doors and the plane occupied by the outer surfaces of the ribs, each of said blocks having a passage extending generally vertically therethrough, said passages being positioned to align coaxially with each other when the doors are closed, so as to form a continuous passage for reception of a bolt extended through the blocks to prevent separation of the doors, at least one of the blocks having a pilot hole of a diameter at least equal to that of the bolt passage extending inwardly from an outer surface of the block on an axis generally perpendicular to but aligned with the axis of the bolt passage and intersecting such passage, whereby a bolt extending through and trapped in the continuous passage can be severed by means of a drill inserted in the pilot hole, and whereby access to the abutting horizontal overlapping surfaces of the blocks is restricted by the ribs as well as by the doors and the blocks.

5. A combination as defined in claim 4 wherein at least one of the blocks extends horizontally a distance which is a substantial proportion of the distance between the ribs when the doors are closed.

6. In a locking system for a pair of substantially planar double doors having free vertical edges movable toward and away from each other during opening and closing thereof and having a vertical reinforcing rib on and projecting outwardly from the outer surface of each door, said ribs being located relatively close to but spaced from the free edge of the door, the novel combination which comprises at least two rectangular keeper blocks, one attached to each rib and extending laterally from the rib parallel to the plane of the door, and at least one thereof extending to a position beyond the free edge of the door, said blocks being of such length horizontally, and staggered vertically to such extent, as to closely overlap vertically when the doors are closed, and lying substantially between the plane of the closed doors and the plane occupied by the outer surfaces of the ribs, each of said blocks having a passage extending generally vertically therethrough, said passages being positioned to align coaxially with each other when the doors are closed, so as to form a continuous passage for reception of a bolt extended through the blocks to prevent separation of the doors, at least one of the blocks having a pilot hole of a diameter at least equal to that of the bolt passage extending inwardly from an outer surface of the block on an axis generally perpendicular to but aligned with the axis of the bolt passage and intersecting such passage, whereby a bolt extending through and trapped in the continuous passage can be severed by means of a drill inserted in the pilot hole, and whereby access to the abutting horizontal overlapping surfaces of the blocks is restricted by the ribs as well as by the doors and the blocks, the ribs being rectangular in horizontal section and rigidly secured to the doors, two vertically spaced blocks being secured to one of said ribs, and a third block secured to the other rib at a position to move into the space between the two first-mentioned blocks when the doors are closed, said third block being so proportioned as substantially to fill the vertical space between said two first-mentioned blocks, the two first-mentioned blocks being of a thickness in a direction perpendicular to the plane of the door which is a substantial proportion of the corresponding dimension of the ribs.

7. A system for securing a door to an adjacent structure comprising a keeper block on the door, a keeper block on the adjacent structure, said keeper blocks being positioned to be in close juxtaposed relation when said door is in the closed condition, each of said keeper blocks having a passage therethrough, said passages being positioned so as to be aligned with each other when the door is in the closed condition thereby forming a continuous passage extending through both blocks for the reception of a bolt, one of said keeper blocks having a pilot hole of a diameter at least equal to that of the bolt passage extending inwardly from an outer surface of the block on an axis generally perpendicular to but aligned with the axis of the bolt passage and intersecting the bolt passage whereby a bolt disposed in and extending through said continuous passage can be severed by means of a drill inserted in the pilot hole, the bolt passage in one block being larger in diameter throughout its full axial length than the bolt passage in the other block, and a lock bolt having heads on both ends, at least one of said heads being radially inwardly compressible to a diameter small enough to pass through the smaller passage but yieldably biased radially outwardly whereby the second-mentioned head expands to oppose return of the bolt through the passages after being projected through the smaller passage into the larger passage.

8. A combination as defined in claim 7 wherein the diameter of the larger passage is less than the diameter to which the second-mentioned head can be expanded when unrestricted.

9. A combination as defined in claim 7 wherein the diameter of the larger passage is less than the diameter to which the second-mentioned head can be expanded when unrestricted, and said second-mentioned head lies within said larger passage when the bolt is moved as far into the passageways as the fixed head will permit.

10. A combination as defined in claim 7 wherein the passage in the block having the larger passage extends only part way through the block from the side which abuts the other block, and the diameter of the larger passage is less than the diameter to which the second-mentioned head can be expanded when unrestricted.

11. A combination as defined in claim 7 wherein the passage in the block having the larger passage extends only part way through the block from the side which abuts the other block, and the diameter of the larger passage is less than the diameter to which the second-mentioned head can be expanded when unrestricted, and said second-mentioned head lies within said larger passage when the bolt is moved as far into the passageways as the fixed head will permit.

* * * * *

UNITED STATES PATENT AND TRADEMARK OFFICE

CERTIFICATE OF CORRECTION

PATENT NO. : 3,951,443

DATED : April 20, 1976

INVENTOR(S) : Perry J. Barnaby

It is certified that error appears in the above-identified patent and that said Letters Patent are hereby corrected as shown below:

Col. 1, line 46, "to" should be --of--.
Col. 4, line 11, after "wall" delete "its top flange 81." and insert --. Its top flange 81 constitutes the effective block portion which cooperates in the actual holding function, and to which the claims may refer as a "block".--
Col. 5, line 41 (Claim 1), "strucure" should be --structure--.

Signed and Sealed this

Twentieth Day of July 1976

[SEAL]

*Attest:*

RUTH C. MASON
*Attesting Officer*

C. MARSHALL DANN
*Commissioner of Patents and Trademarks*